US005341123A

United States Patent [19]

Schuman, Sr. et al.

[11] Patent Number: 5,341,123

[45] Date of Patent: Aug. 23, 1994

[54] PORTABLE DOOR ALARM

[76] Inventors: Ralph J. Schuman, Sr., P.O. Box 1161, Absecon, N.Y. 08201; Robert J. Schuman, P.O. Box 848, Hammonton, N.J. 08037

[21] Appl. No.: 161,819

[22] Filed: Dec. 6, 1993

[51] Int. Cl.[5] ..... G08B 13/08

[52] U.S. Cl. ..... 340/546; 200/61.93; 340/545; 340/549

[58] Field of Search ..... 340/546, 549, 545; 200/61.93

[56] References Cited

U.S. PATENT DOCUMENTS

| | | | |
|---|---|---|---|
| 3,261,010 | 7/1966 | Kurdel | 340/546 |
| 3,270,333 | 8/1966 | Barber | 340/546 |
| 3,878,539 | 4/1975 | Gooding | 340/546 |
| 4,059,832 | 11/1977 | Conklin | 340/546 |
| 4,484,181 | 11/1984 | Schwartz | 340/521 |
| 4,808,974 | 2/1989 | Cantley | 340/546 |
| 5,072,212 | 12/1991 | Sorenson | 340/546 |

*Primary Examiner*—Glen Swann

*Attorney, Agent, or Firm*—Richard C. Litman

[57] ABSTRACT

A portable door alarm having an alarm pushbutton switch extending from the back of the housing of the alarm has a first L-shaped member hingeably attached to a bottom portion of the housing. At the top of the first L-shaped member is a bracket hanger which fits over the top of a door. The first L-shaped member is biased to close the hinge, thereby placing the first L-shaped member in close proximity to the housing. A leg portion of a second L-shaped member, having a longitudinal portion attached to the back of the housing, is located above the hanger and pushes against a wall portion above the door once the device is placed on the door and the door is closed. If the door is reopened, with the alarm set, an engaging portion of the first L-shaped member presses the alarm pushbutton switch as the L-shaped member returns to its close proximity to the back of the housing due to the biasing thereof. An alarm sounds once the engaging portion depresses the alarm pushbutton switch with the alarm set.

5 Claims, 3 Drawing Sheets

PORTABLE DOOR ALARM

BACKGROUND OF THE INVENTION

1. Field of the Invention

The present invention relates to portable intruder alarm systems used to detect the opening of a door. More particularly, the device of the present invention pertains to those portable intruder alarm systems which are hung from the top of a door and engage the wall above the door as the door is closed.

2. Description of the Prior Art

Some of the portable door intruder alarms which are attached to the top of a door sound an alarm once the door is opened by detecting the motion of a biased member pushing against the wall above the door as the door is closed with the device attached thereto. Various arrangements are provided in the prior art for attaching the device to the door and for detecting the opening of the door.

U.S. Pat. No. 3,261,010 issued Jul. 12, 1966 to John V. Kardel illustrates a portable door alarm having a fixed plate extending up from the back thereof with a slit therethrough for allowing a clamp to slide therein across the top of the device. The clamp includes a downward protruding leg member at the back thereof to secure the device to a door. A finger, which normally extends vertically from the top rear of the device engages the wall when the door is shut with the device attached thereto so as to push the finger forward as it makes contact with the wall above the door. Once set, the alarm device will sound a horn if the finger returns to its normal position towards the rear of the device.

U.S. Pat. No. 3,878,539 issued Apr. 15, 1975 to Chadyeane Gooding discloses a portable door alarm having an L-shaped member with a slit through the elongated portion thereof. A screw attaches to the top of the device through the slit allowing the L-shaped member to serve as an adjustable bracket, securing the device to the top of a door. A coil arm having a tip member extends from the top of the device and is normally located near the rear wall thereof so that the tip member engages the wall above the door and pushes the coil arm forward when the door is closed with the device attached thereto. If the alarm is set, and the door is opened the coil arm returns to its normal rearward location and sounds a warning device.

U.S. Pat. No. 4,059,832 issued Nov. 22, 1977 to LeRoy T. Conklin discloses an portable door alarm having an L-shaped member having a bracket at the end of an elongated portion. The elongated portion is hingeably attaching to the bottom end of the back of the device. The hinge has a torsion spring biasing the hook towards the back of the device. When the bracket is placed over the top of a door, the spring biases top portion of the device towards the door. The top portion extends above the door when the hook portion is placed over the top of the door. A pushbutton extends out from the back of the top portion and engages the wall above the door when the door is closed with the device attached thereto. With the device set and the door closed, the pushbutton is pressed down due to the force of the torsion spring holding the top portion of the device against the wall. If the door is then opened so that the pushbutton extends to its normal position, a buzzer alarm sounds.

U.S. Pat. No. 4,484,181 issued Nov. 20, 1984 to Frederic W. Schwartz discloses a portable burglar alarm having an L-shaped elongated member slidably extending along the length of the device and being spring biased to pull the smaller leg portion thereof towards one side thereof. The leg is able to engage the outside of the door and pull the one side towards the front side of the door, thus maintaining the device on the top of the door. A lever at the top of the is biased towards the wall above the door through the use of a torsion spring so as to engage the wall. If the door is opened with the device attached thereto and the alarm set, the lever is rotated towards the wall and a horn is activated.

U.S. Pat. No. 4,808,974 issued Feb. 28, 1989 to Richard E. Cantley discloses a portable door alarm adapted to be removably mounted on the top edge of an inwardly swinging door. The device has an adjustable mounting bracket which extends from one end of the top of the device to the other and has a downwardly protruding leg to engage the outside portion of the door along the top thereof. The bracket includes several slots at the ends thereof a pair of screws, one at each end, are inserted to secure the bracket in a fixed adjustable position. A middle slot through the bracket allows a lever to project therethrough above the top of the device. The lever is biased to move behind the back of the device so as to engage a wall above the device once attached to the top of a door with the door shut. The lever is pushed forward when contacting the wall as the door is closed. When the door is opened with the alarm set on the device, a buzzer sounds when the lever moves backwards as the door is opened and the top of the wall no longer engages the lever.

U.S. Pat. No. 5,072,212 issued Dec. 10, 1991 to Gary R. Sorenson discloses a portable alarm device having a pair of brackets extending out from the rear of the device. As the door is closed, a trip switch lever extending from the top of the device is biased to engage a wall above the device once the door is closed. The device is activated and a buzzer sounds, once the door is opened and the lever disengages the wall.

None of the above patents, taken either singly or in combination, is seen to describe the instant invention as claimed.

SUMMARY OF THE INVENTION

The portable door alarm of the present invention includes a rectangular housing having a first L-shaped member with a bracket hanger on a top end of the longitudinal portion thereof. The first L-shaped member is pivotally attached to the back side of the housing through the use of a hinge located at the bottom end of the longitudinal portion thereof. A biasing member maintains the longitudinal portion of the first L-shaped member in its normal position proximate to the back side of the housing with the hinge closed. A longitudinal portion of a second L-shaped member extends upwards from the back side of the housing above the top of the housing and the bracket hanger of the first L-shaped member. A leg portion is located at the top end of the longitudinal portion of the second L-shaped extends. The hinge is attached to the bottom ends of the longitudinal portions of both the first and second L-shaped members. Between the back side of the housing and the longitudinal portion of the first L-shaped member is a pushbutton switch extending out from the back of the device and contacting an engaging portion attached to the longitudinal portion of the first L-shaped member when the longitudinal portion of the first L-shaped member is in its normal position.

If the bracket hanger of the first L-shaped member is placed on top of a door and the door is closed, the leg of the second L-shaped member will engage the wall above the door as the door is closed, thereby pushing the top portion of the device away from the door as the hinge begins to open. As stated above, a pushbutton switch extends out from the back of the portable door alarm device. Preferably, an aperture is provided in the longitudinal portion of the second L-shaped member for allowing the pushbutton to extend therethrough so as to contact the engaging portion of the first L-shaped member when it is located in its normal position maintaining the pushbutton in a pressed state. As the leg of the second L-shaped portion pushes on the wall located above the door as the door is closed with the device placed thereon, the two L-shaped portions become further apart as the hinge opens, thereby placing the pushbutton in an unpressed state. With the alarm of the device set and the pushbutton in its unpressed state, an alarm buzzer is disabled. With the alarm device of the present invention set and attached to a closed door causing the two L-shaped members to be separated, the pushbutton is maintained in its unpressed state. As the door is opened and the leg of the second L-shaped member tries to maintain contact with the door due to the force of the biasing member, the engaging portion comes back into contact with the pushbutton, thereby pressing the pushbutton and enabling an alarm buzzer to sound to indicate that an intruder has entered through the door.

Accordingly, it is a principal object of the invention to provide a portable door alarm which may be easily installed without the need of attaching screws or manually adjustable brackets. Some prior portable alarm devices include brackets or clamps which need to be attached by screws or must be manually adjusted to be installed, such as Kardel, Gooding, Schwartz, Cantley, and Sorenson cited above.

It is another object of the invention to provide a portable door alarm with simple alarm switch to detect the opening of a door in order to increase reliability and ease of manufacture for the alarm device. The device of the present invention uses a rearwardly disposed alarm push button pressed as the door is opened to activate the alarm. For example, Kardel uses a complicated master control arm as the alarm switch, wherein the master control arm is pivotally attached within the housing and includes a cam portion attached thereto which engages a pair of movable contacts.

It is a further object of the invention to prevent the alarm switch from direct contact with the wall as the door is closed to prevent excessive force used to close or push the alarm switch as the door is closed so as to reduce the wear on the device, thereby increasing its reliability. For example, in the devices of Kardel, Gooding, Conklin, Schwartz, Cantley, and Sorenson, the alarm switch comes into contact with the wall above the door as the door is closed. If the door is slammed, the alarm switches of the prior art may become damaged due to the rapid forces exerted thereon upon slamming the door shut. However, in the device of the present invention, only the leg of the second L-shaped member comes in contact with the wall as the door is closed. The actuation switch is released as the door is closed and the engaging portion of the second L-shaped member is moved away from the alarm pushbutton switch. Therefore, no unpredictable forces are exerted on the alarm switch as the door is closed. As the door is opened, it is the force of the biasing member which causes the engaging portion to push on the alarm pushbutton. This is a predictable force in accordance with the design specification of the biasing member and the forces necessary to push the alarm pushbutton, which is well within the scope of one of ordinary skill in the art to design.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
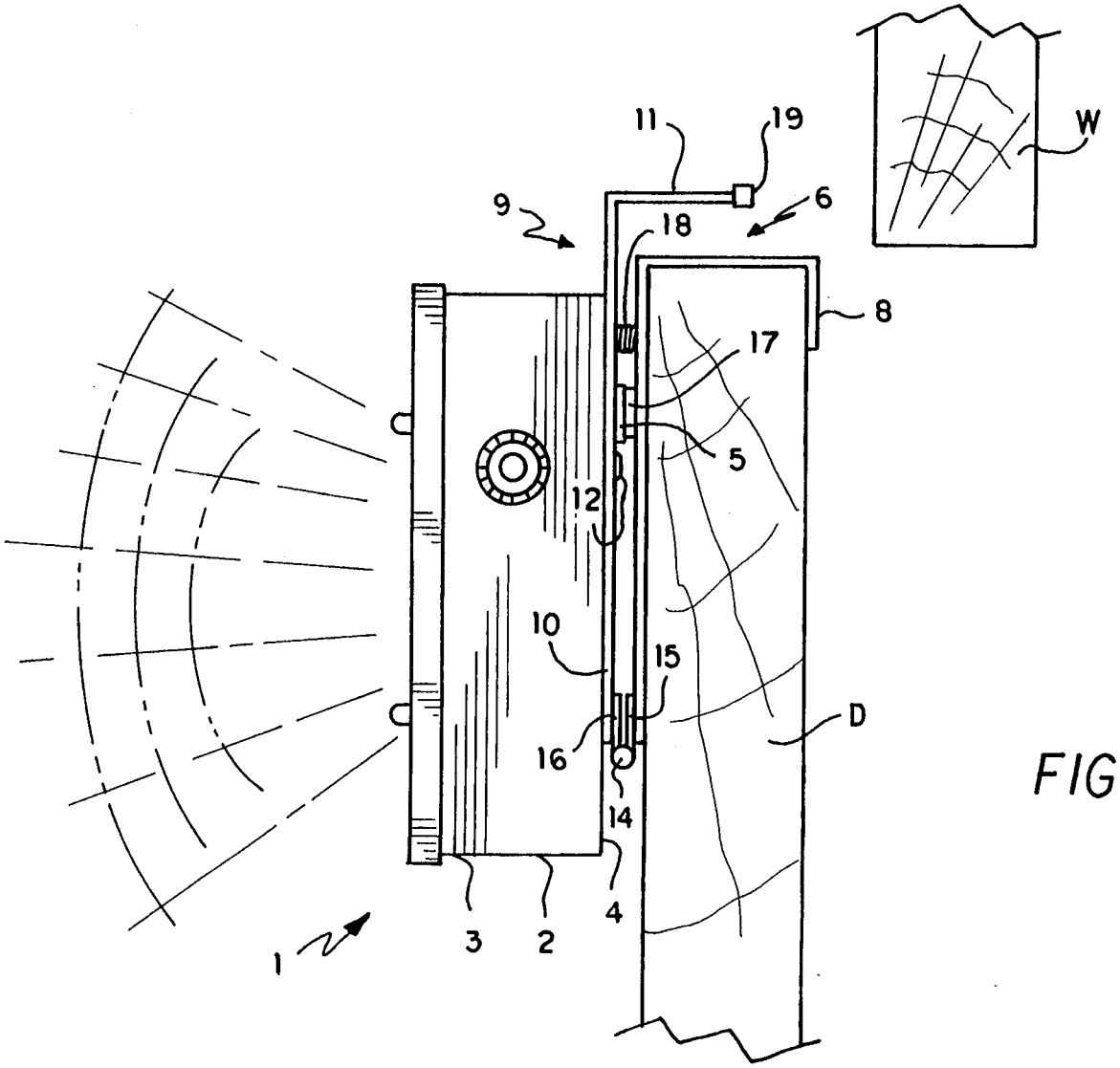
FIG. 1 is an environmental side view of the present invention attached to an open door.

As shown in FIG. 1, the portable door alarm 1 of the present invention includes a housing 2 having a front side 3 and a back side 4. An alarm pushbutton switch 5 extends out the back side 4 of the housing 2 to engage part of a first L-shaped member 6 as will be described below. The first L-shaped member 6 includes a longitudinal portion 7 and a bracket hanger 8 attached to a top end of the longitudinal portion 7.

A second L-shaped member 9 includes a longitudinal portion 10 having a leg portion 11 extending from a top end of the longitudinal portion 10. In the preferred embodiment, the leg portion 11 extends out away from the back side 4 in a direction perpendicular to the longitudinal direction of the longitudinal portion 10. The second L-shaped member 9 is secured to the back side 4 of the housing 2 through the use of an attachment device 12, such as a screw or rivet. An opening 13 within the second L-shaped member shown in FIG. 3 allows the alarm pushbutton switch 5 to extend therethrough and engage part of the first L-shaped member 6.

Figure 3:
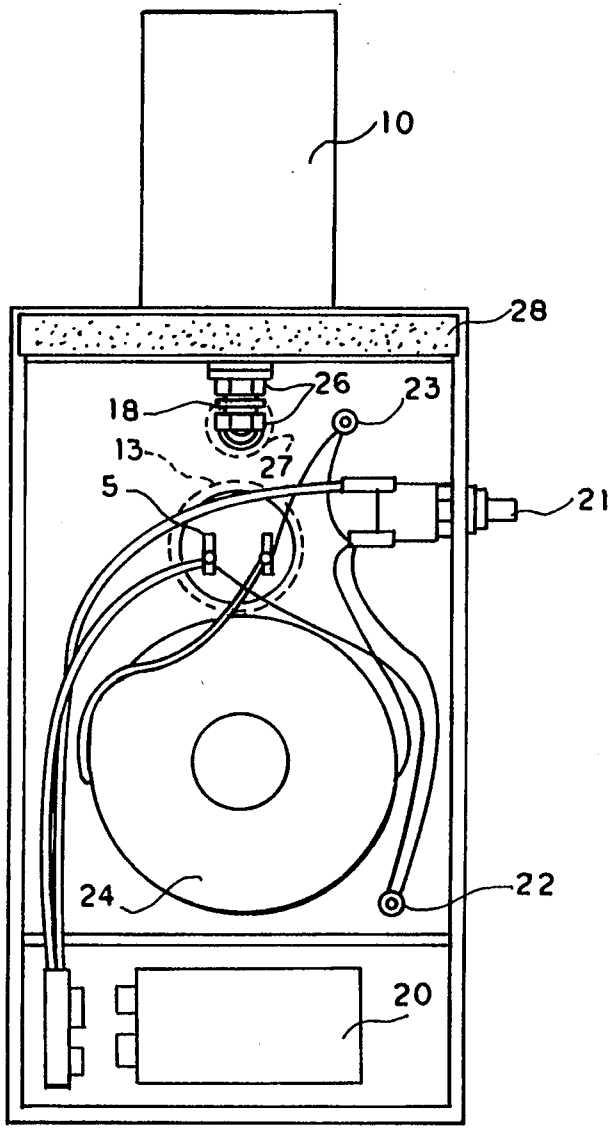
FIG. 3 is a front view of the present invention with the front cover removed therefrom.

A hinge 14 is used to couple the two L-shaped members. The hinge 14 has a first end 15 attached to the bottom of the longitudinal portion 7 of the first L-shaped member 6 and a second end 16 attached to the bottom of the longitudinal portion 10 of the second L-shaped member 9. A coil spring 18 attached at one end to an upper end of the longitudinal portion 7 and at an opposite end within the housing 2 as illustrated in FIG. 3 and discussed in more detail below. The coil spring 18 urges the first L-shaped member 6 to maintain its normal position directly adjacent to the second L-shaped member 9. In its normal position, the first L-shaped member 6 is close to the back side 4 of the housing 2 and an engaging member 17 attached to the longitudinal portion 7 presses against the alarm pushbutton switch 5 placing it in its depressed state. The engaging member 17 is preferably a rubber portion glued to the longitudinal portion 7. An alarm sounds when the alarm control circuitry of the device is set and the alarm pushbutton switch 5 is depressed.

Figure 4:
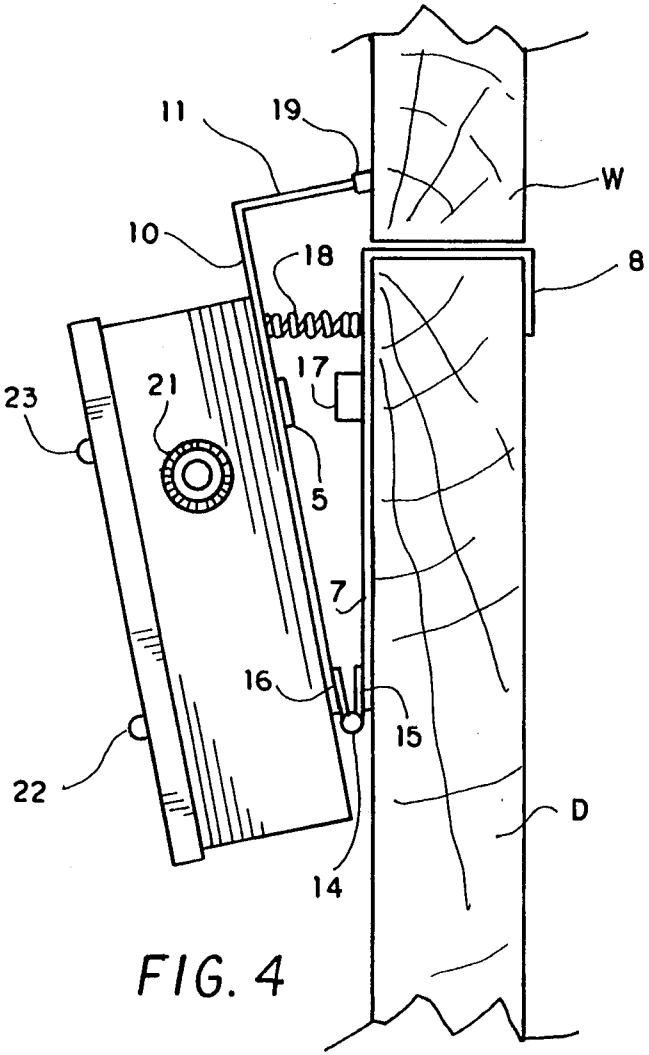
FIG. 4 is an environmental side view of the present invention attached to a closed door.

As illustrated in FIG. 1, the portable door alarm 1 is designed to be easily installed on a door D by simply hanging the device 1 thereon through the use of the bracket hanger 8. Normally the alarm control circuitry is unset when initially installed on the door D. In this manner the alarm is not sounding. Once the device 1 is installed on the door D and the door D is closed as shown in FIG. 4, the alarm control circuitry is normally set. The alarm does not sound because the engaging member 17 does not press on the alarm pushbutton switch 5 once the door D is closed. As shown in FIG. 4, the leg portion 11 of the second L-shaped member 9 pushes against the wall W above the door, thereby allowing the hinge 14 to open as the second L-shaped member 9 to move away from the first L-shaped member 6. At the end of the leg portion 11 is a rubber portion 19 to prevent damage to the wall W as it comes into contact therewith.

With the alarm control circuitry of the portable door alarm 1 set once the door D is closed with the device 1 attached thereto as shown in FIG. 4, if the door is opened as shown in FIG. 1, the biasing member 18 urges the first L-shaped member 6 back to its normal position adjacent the second L-shaped member 9. The engaging member 17 then presses on the alarm pushbutton switch 5, thereby sounding the alarm.

Figure 2:
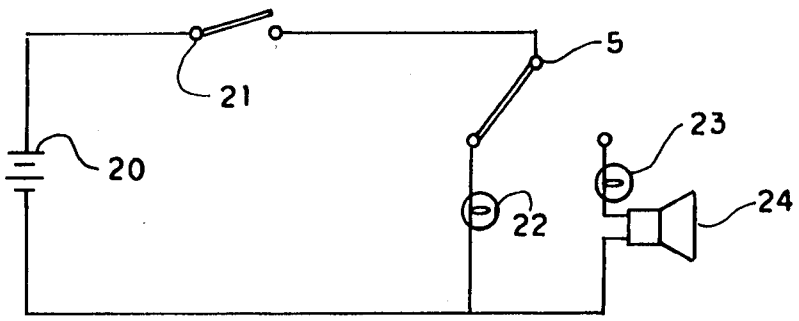
FIG. 2 is an electrical schematic diagram for the present invention.

The alarm control circuitry is illustrated in FIG. 2. A battery 20 is connected in series with an alarm set switch 21. In series with both the battery 20 and the alarm set switch 21 is the alarm pushbutton switch 5 which selectively provides power from the battery 20 with the alarm set switch 21 closed to a visual set indicator 22 when the alarm pushbutton 5 is in its unpressed state as shown in FIG. 4 and a visual alarm display 23 and buzzer 24 when the alarm pushbutton switch 5 is in its depressed state as shown in FIG. 1.

Figure 5:
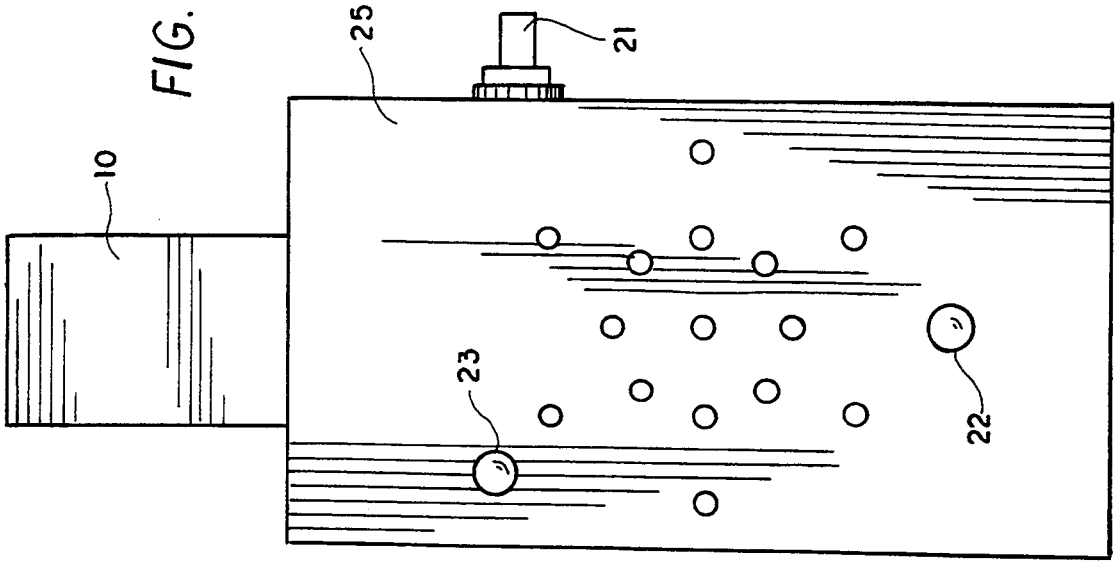
FIG. 5 is a front view of the present invention with the front cover attached thereto.

As stated above, the housing 2 includes a front side end 3. As illustrated in FIG. 5, the front side end includes a cover 25 which fits over an opening of the front side end 3 of the housing 2. The cover 25 has the visual alarm display 23 and the visual set display 22 attached thereto. The visual set display 22 indicates that the alarm set switch 21 is set to provide power to the buzzer 24 and the visual alarm display 23 as soon as the alarm pushbutton switch 5 is depressed by the engaging portion 17 once the door D is opened. The visual alarm display 23 may be located at a remote site rather than directly on the cover 25 (not illustrated).

As illustrated in FIG. 3, the coil spring biasing member 18 is attached to the housing 2 via a nut and screw arrangement 26. An opening 27 in the longitudinal portion 10 allows the spring 18 to extend therethrough to the longitudinal portion 7 to which the spring 18 is attached. A hook strip 28 is secured to the top front portion 3 so as to engage a loop strip (not illustrated) attached to the cover 25 to secure the cover 25 over the opening of the front portion 3.

It is to be understood that the present invention is not limited to the sole embodiment described above, but encompasses any and all embodiments within the scope of the following claims.

We claim:

1. A portable door alarm comprising:

a housing having a front side and a back side;

an alarm pushbutton switch extending out from the back side of the housing having a depressed stated and an unpressed state;

a first L-shaped member having a longitudinal portion with a bracket hanger attached at a top end thereof;

a second L-shaped member having a longitudinal portion with a leg portion extending therefrom along a top end thereof;

means for attaching said second L-shaped member to the back side of said housing;

an opening within the longitudinal portion of said second L-shaped member for allowing said alarm pushbutton switch to extend therethrough;

a hinge having a first end thereof connected to a bottom end of said first L-shaped member and a second end thereof connected to a bottom end of said second L-shaped member, said hinge having a closed position maintaining the first L-shaped member in its normal position proximate to said back side of said housing and adjacent to said second L-shaped member;

an engaging member extending from said longitudinal portion of said first L-shaped member to said alarm pushbutton switch for contacting said alarm pushbutton switch thereby placing said alarm pushbutton switch in its depressed state when said first L-shaped member is located in its normal position adjacent to said second L-shaped member;

a biasing member for urging said first L-shaped member to maintain its normal position;

an audible signal generator for producing a distinct audible signal when activated; and alarm control circuitry having an alarm set state and an alarm unset state, said alarm control circuitry activating said audible signal generator when said alarm pushbutton switch is located in its depressed state and said alarm control circuitry is in said set state.

2. A portable door alarm as claimed in claims 1, wherein said alarm control circuitry comprises an alarm set switch for selectively setting said alarm control circuitry in said set state and said unset state.

3. A portable door alarm as claimed in claim 1, wherein said alarm control circuitry includes a visual alarm display activated simultaneously with said audible signal generator.

4. A portable door alarm as claimed in claim 1, wherein said biasing member includes a coil spring having one end thereof attached to said longitudinal portion of said first L-shaped member and an end opposite said one end connected within said housing.

5. A portable door alarm as claimed in claim 1, wherein said alarm control circuitry includes a battery connected in series with an alarm set switch which in turn is connected in series with said alarm pushbutton switch which, when said alarm control circuitry is set to said set state by said alarm set switch, selectively provides power from said battery to a visual alarm display and said audible signal generator when said alarm pushbutton switch is in said depressed state and to a visual set indicator for indicating that said alarm set switch is in its set state when said alarm pushbutton switch is in said unpressed state.

* * * * *